United States Patent [19]

Berger et al.

[11] 4,415,121

[45] Nov. 15, 1983

[54] VALVE FOR SPRAYING A MIST

[75] Inventors: Richard F. Berger, Huntington; Greg Pardes, New York; Bernard R. Gerber, Jamaica, all of N.Y.

[73] Assignee: The Reseal Corporation of America, New York, N.Y.

[21] Appl. No.: 273,023

[22] Filed: Jun. 12, 1981

[51] Int. Cl.[3] ..... B05B 3/14

[52] U.S. Cl. ..... 239/229; 239/327; 239/533.1

[58] Field of Search ..... 239/102, 229, 327, 533.1, 239/533.13, 542, 545, 602, 590.3, 590.5

[56] References Cited

U.S. PATENT DOCUMENTS

| | | | |
|---|---|---|---|
| 755,880 | 3/1904 | Johnson | 239/590.5 X |
| 3,018,971 | 5/1959 | Cheney | 239/338 |
| 3,214,102 | 10/1965 | Meyer | 239/602 X |
| 3,269,644 | 8/1966 | Lamb et al. | 239/602 X |
| 3,804,337 | 4/1974 | Schmdhuber et al. | 239/602 X |

*Primary Examiner*—Jeffrey V. Nase
*Assistant Examiner*—Paul A. Sobel
*Attorney, Agent, or Firm*—Toren, McGeady and Stanger

[57] ABSTRACT

A valve for spraying material as a mist includes walls forming an elongated passageway having an inlet and an outlet. The passageway is flattened at least at the outlet end. The flattened portion has opposed walls disposed in contact and at least one of the surfaces of the flattened portion has a plurality of capillary-like channels. Upstream from the channels, the valve has a flexible wall section which vibrates at its natural frequency when the material to be sprayed as a mist is forced through the passageway out of the valve.

29 Claims, 5 Drawing Figures

VALVE FOR SPRAYING A MIST

SUMMARY OF THE INVENTION

The present invention is directed to a valve for spraying material as a mist and, more particularly, it is directed to such a valve for use in combination with collapsible containers.

When a material, such as a liquid, is to be sprayed as a mist, the usual technique is to break up the liquid stream into finely divided spherical droplets of a definite size distribution. Normally this is referred to as atomization and typically a compressed gas is employed to subdivide the liquid into droplets. In forming the spray mist there must be a certain relationship between the various features of the valve, the pressure acting on the material to be atomized, and the viscosity and density of the material.

In the past rigid walled containers have been used for discharging spray mist. When a certain amount of the material has been displaced out of the container an equivalent volume is needed to replace it using either the expansion of a compressed gas within the container (aerosol) or the replacement with air (standard air pump). If, instead of a rigid walled container, a flexible collapsible container is utilized it is unnecessary to replace the volume of the material discharged from the container. A collapsible container of the general type to which the present invention is directed is disclosed in U.S. Pat. No. 3,506,163 to Rauh et al. In such containers the side walls collapse as the material is discharged so that the extent to which the container has collapsed is indicative of the amount of material remaining in the container.

Therefore, the primary object of the present invention is to provide a valve for use with collapsible containers for spraying a material as a mist.

Another object is to provide a simple valve structure which can be produced at low cost.

In accordance with the present invention, the spray mist valve includes an elongated flexible member forming a laterally closed passageway with an inlet end arranged to receive the material sprayed as a mist and an outlet end from which the mist is sprayed. At least a portion of the flexible member is flattened from the outlet end toward the inlet end. At least a part of the flattened portion defining part of the passageway contains a plurality of capillary-like channels terminating at the outlet end. Upstream from the channels the opposite walls of the passageway in the flattened portion are disposed in sealing contact when the valve is in its at-rest condition. Further, upstream from the location at which the flattened walls are in sealing contact, the flexible member forms an open passageway part and at least a portion of the surface of the member defining the open passageway part vibrates at its natural frequency when the material to be sprayed as a mist is forced through the passageway. The combination of the flexible oscillating part of the member and the capillary-like channels disperse the stream of material flowing through the passageway into fine droplets and produce a mist having a droplet size determined by the diameter of the channels, the rate of flow through the channels and the frequency of oscillation.

In a preferred embodiment, the flexible member is formed of a plastics or elastomeric material. From the outlet end, the flexible member is flattened for at least a portion of its length so that in the at-rest condition its flattened walls contact one another and provide a closure preventing flow into the capillary-like channels. The channels may be formed in only one or in both of the opposed walls of the member. While the channels may have various transverse cross-sectional shapes, a rounded channel generally provides the optimum formation of the desired droplet size. If the channels are formed in only one of the opposed walls, a half round channel would be preferred. Because of its flexible character the member starts to oscillate or vibrate at its natural frequency as the material is forced through the passageway in the valve. With the combination of oscillation and the size of the channels, the material can be discharged from the outlet end of the passageway in a mist.

In combination with a flexible collapsible container the material stored in the container, preferably a liquid, can be discharged in a mist of fine droplets and it is unnecessary to replace the discharged material, since the collapsible container follows the level of the material within it. In the usual collapsible container, such as shown in the above-mentioned Rauh et al patent, initially the container is filled with the material to be dispensed. By forcing the ends of the container through one another the material within it is pressed out preferably through a self-closing valve. During use, the material being discharged also fills the valve up to the closure formed by the valve. When a collapsing pressure is applied to the container, the valve opens and discharges a certain amount of material as long as the pressure is maintained. When the pressure is released the valve closes and the container remains in the collapsed condition. It is unnecessary to provide a pressurized gas within the container to force the material out. Furthermore, air does not have to be introduced into the container in place of the discharged material if a pressurized gas is not used. When the collapsing pressure is released from the container, in its collapsed state it is completely filled with the material to be dispensed. There may be a slight rebound of the collapsible container when the collapsing pressure is released developing a slight suction within the container enhancing the closing action of the self-closing valve.

A self-closing valve can be of the bladder type which remains closed as long as the material within the container is not pressurized above a point at which the valve opens.

Primarily, the present invention is directed to such a valve which remains in the closed condition as long as the material within the collapsible container is not pressurized to a level at which the valve opens.

It would be possible to provide a collapsible container combined with a tension spring which biases the container into the collapsed condition. In such a container, a positive closure of the outlet passageway is required to assure that the pressure generated by the tension spring does not discharge the material. If the positive closure is opened the tension spring causes the material within the collapsible container to be discharged through the valve until the positive closure is returned to the closed condition. Such a collapsible container is particularly useful when it is desired to afford a regulated flow of the material in the form of a spray mist.

In place of a tension spring the collapsible container could be combined with a compression spring which biases the opposite ends of the container apart. When it is desired to discharge material from the container the force of the spring must be overcome so that the material fills and opens the outlet valve. When the pressing force on the container is released the compression spring tends to return the container to its expanded condition developing a suction space within the upper part of the container and in the valve, and enhancing the closing effect on a bladder valve.

While it would be possible to place the flexible member forming the spray valve on the outlet from the collapsible container without any protection, it is preferable to enclose it within a rigid enclosure to protect the spray valve and also to avoid any interference with the desired oscillating effect.

Typical materials for use as the flexible tubular member are natural or synthetic rubbers, plastics materials or other materials having a similar flexible characteristic.

The collapsible container can have a bellows-like shape, a helical shape or other configuration which tends to follow the level of material in the container and collapse as the material is discharged.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DETAIL DESCRIPTION OF THE INVENTION

Figure 1:
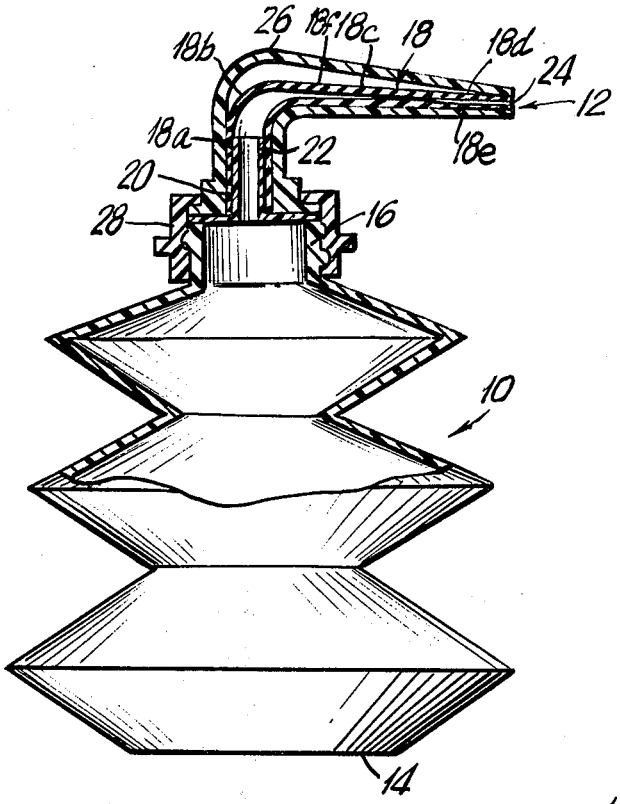
FIG. 1 is an elevational view, partly in section, of a device embodying the present invention with a mist valve mounted on the outlet from a collapsible container.

In FIG. 1 a device for dispensing material, such as a liquid, in a mist-like spray, is made up of a collapsible container 10 and a mist valve 12.

The container 10 is in the shape of a bellows and collapses as the material is discharged from it. To simplify the drawing, the material is not shown within the container or the valve. Container 10 is closed at the bottom 14 and has a reduced diameter neck 16 through which the stored material is discharged. The container is formed of a flexible elastomeric or plastics material, and depending on the type of material dispensed it may be reusable.

The mist valve 12 is formed by an axially elongated flexible member 18 having an inlet end 20 fitted onto a flanged sleeve 22 supported on the neck 16 of the container 10. It is possible that other means could be used in place of a tubular member as long as such means define an elongated passageway. As shown in FIG. 1, the tubular member 18 has an L-shaped axis with the outlet end 24 of the tubular member located transversely outwardly from the axis of the container 10. Tubular member 18 is enclosed from the container neck 16 to its outlet 24 within a rigid enclosure or sleeve 26 having the same general shape as the tubular member. The sleeve 26 supports the lower side of the tubular member 18 and is spaced outwardly from the upper side of the tubular member. The sleeve 26 secures the inlet end 20 of the tubular member 18 about the flanged sleeve 22 and a cap nut 28 connects the assembly of the rigid sleeve 26, the inlet end 20 of the tubular member 18 and the flanged sleeve 22 on the outlet end or neck 16 of the container 10.

Figure 2:
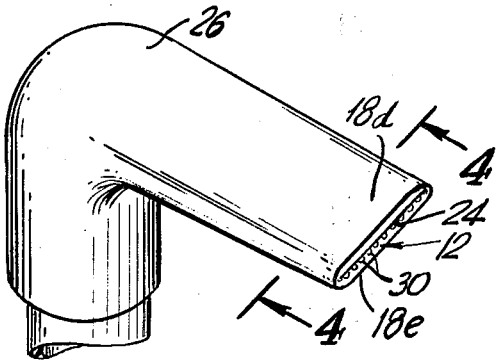
FIG. 2 is an enlarged perspective view of the valve illustrated in FIG. 1.
Figure 3:
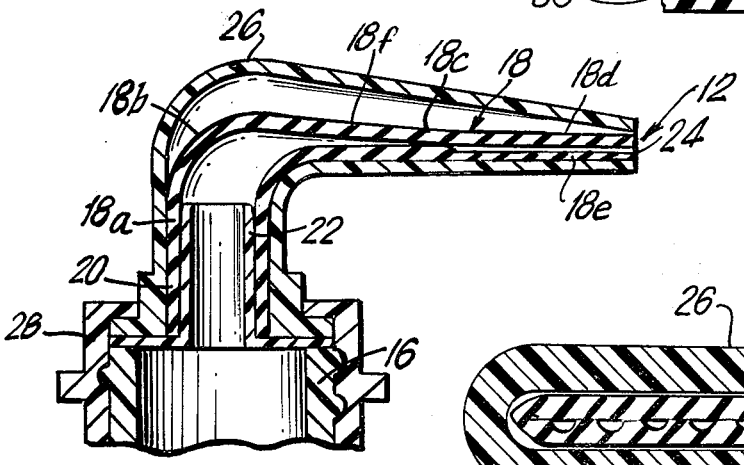
FIG. 3 is an enarged cross-sectional view of the valve and the upper end of the container as shown in FIG. 1.

As can be seen in FIGS. 1 and 3, the tubular member 18 has an inlet portion **18*a* extending generally upwardly from the container. A bent intermediate portion 18*b* extends from the upper end of the upright inlet portion 18*a* to a generally horizontally extending outlet portion 18*c* which terminates at the outlet end 24 of the tubular member. The inlet portion 18*a* has a rounded cross-section, however, as the tubular member is bent from the rounded inlet portion 18*a* its cross-section is gradually flattened so that the horizontally extending portion 18*c* has the configuration shown in FIG. 2. The intermediate portion 18*b*** forms a transition between the other two portions.

As shown enlarged in FIG. 3, the outlet portion **18*c* consists of upper wall part 18*d* and lower wall part 18*e* which are in contact from the outlet end 24 to the point between the outlet end and the intermediate portion 18*b*. As viewed in FIGS. 1 and 3 the valve 12 is in the at-rest condition, that is, the valve is closed and no material is being discharged from the container 10. A part of the tubular member in the region of the intermediate portion 18*b* and the outlet portion 18*c* forms an oscillating section 18*f***.

Starting at the outlet end 24, half round capillary-like channels 30 are formed in the lower wall part **18*e*. The channels 30 are arranged in generally parallel relation in the lower wall and extend from the outlet 24 to a location just short of the position where the contacting engagement of the upper wall port 18*d* and the lower wall part 18*e* terminates. As a result, in the at-rest position as illustrated in the drawings, the passageway through the valve is closed by the contacting engagement of the opposite walls of the horizontal portion 18*c*. The tubular member is constructed so that it remains in the closed at-rest condition until a force is applied opening the passageway. This contacting engagement provides a seal for the upstream ends of the channels 30**.

In the enlarged perspective view in FIG. 2, it can be seen that the upright inlet portion **18*a* fits downwardly over the flanged sleeve 22. When material, such as a liquid is to be discharged from the container 10 the container is compressed in its axial direction and material is forced through the flanged sleeve 22 into the upper part of the inlet portion 18*a* of the tubular member. By maintaining the force generated in the container the liquid displaced into the tubular member 18 separates the upper and lower wall parts 18*d*, 18*e* admitting the liquid into the channel 30 so that it is sprayed as a mist from the outlet 24. The mist is formed by the oscillating section 18*f* located upstream from the position where the contacting engagement of the upper wall part 18*d* and lower wall part 18*e* terminate. When the material is forced out of the container 10 into the tubular member 18, the oscillating section 18*f* starts to vibrate at its natural frequency and the vibrating effect is transmitted to the material flowing through the valve 12. As the material continues into the flattened outlet portion 18*c*** the upper wall part 18*d* and the lower wall part 18*e* separate admitting the liquid into the channels 30 which determine the size distribution of the droplets to be sprayed from the outlet end 24 of the valve 12.

As shown in the drawings, the inner surface of the upper wall part 18*d* is completely smooth and seats against the surface of the lower wall part 18*e* containing the channels 30. The vibrating effect initiated upstream from the channels continues through the channels assuring that the liquid or other material from the container is dispensed as a mist.

While the surface of the upper wall part 18*d* forming the passageway is shown as being completely smooth, it would be possible to provide both surfaces with semicircular channels or channels of other shapes so that they align opposite one another to form the desired outlet channels. Furthermore, channels could be formed in the contacting surface of both the upper wall part 18*d* and the lower wall part 18*e* but with the channels offset from one another in the direction transverse to the axial direction of the tubular member 18.

The rigid sleeve 26 protects the tubular member 18 when it is in the mist spraying condition so that it continues to operative effectively without any outside influence limiting the oscillating character of the horizontal portion 18*c*. The valve could be operated without the sleeve 26, however, under certain conditions the valve might not operate as effectively as desired.

Figure 5:
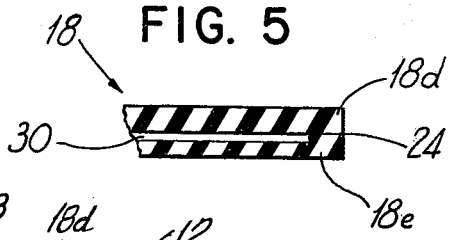
FIG. 5 is a partial sectional view of another embodiment of the invention taken in the outflow direction at the outlet end of the mist valve.
Figure 4:
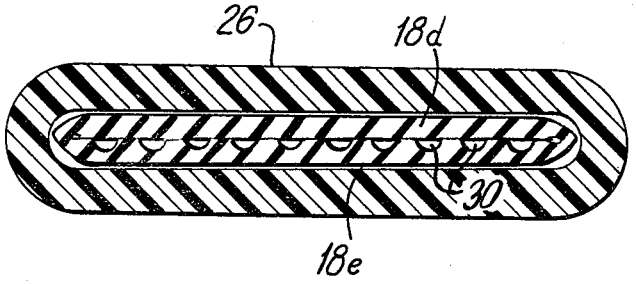
FIG. 4 is an enlarged sectional view of the valve taken along the line IV—IV in FIG. 2.

In FIG. 4 the channels 30 are shown as half round. It is believed that this configuration is the most effective in forming the desired droplet size. It is possible, however, to shape the channels other than half round. Further, the ends of the channels 30 can be spaced closely from the outlet end 24, such as about 2–3 mm, so that the outlet end face forms a closure for the channels, note FIG. 5.

In the drawings the flexible container collapses as material is dispensed from it. The valve provides the desired closure for the container during operation. As long as there is no collapsing force acting on the container, the valve 12 seals the interior of the container and prevents any leakage of the material to be dispensed as a mist and also prevents any flow of outside air through the channels 30 into the container. There are other shapes of collapsible containers which operate in the same manner. Moreover, a compression spring or tension spring could be incorporated with the container 10. If a compression spring is used it biases the container into the expanded condition so that, after material is discharged, a suction space is established within the container and the valve inwardly of the contacting portion forming the closure for the valve. The suction action within the container enhances the closing action of the valve. If, however, a tension spring is used it maintains a collapsing force on the container and it is necessary to provide a positve closure for the valve to assure that the action of the spring does not cause material to be dispensed when the container and valve are in the at-rest condition. By opening the positive closure, the collapsing force acting on the container causes the material to be discharged so that it is only necessary to manipulate the positive closure to obtain regulated discharge of the material in a mist spray.

While specific embodiments of the invention have been shown and described in detail to illustrate the application of the inventive principles, it will be understood that the invetion may be embodied otherwise without departing from such principles.

We claim:

1. A mist valve comprising wall means forming an axially elongated passageway having an inlet end arranged to receive the material to be sprayed as a mist and an outlet end from which the mist is sprayed, at least a portion of said wall means is flattened from the outlet end toward the inlet end, said wall means having an at-rest condition and a mist spraying condition and comprising a generally flat first wall and a generally flat second wall located opposite said first wall with said first and second walls disposed in contact in the at-rest condition of said wall means from said outlet end for at least a part of the length of said passageway toward said inlet end, at least one of said first and second walls having capillary-like channels therein extending in the elongated direction of and open to said passageway with said channels extending from approximately said outlet end for a part of the length of said passageway disposed in contact in the at-rest condition of said wall means, at least a part of said wall means between said inlet end and said channels is flexible and vibrates when said passageway is in the mist spraying condition and material to be sprayed is forced therethrough, and the facing surfaces of said first and second walls are in sealing contact for a portion of the length of said passageway between the ends of said channels closer to said inlet end and said inlet of said wall means and form a seal closure preventing the flow of material through said passageway while said wall means is in the at-rest condition.

2. A mist valve, as set forth in claim 1, wherein said first and second walls are joined together along the elongated edges thereof.

3. A mist valve, as set forth in claim 2, wherein said first and second walls are formed integrally.

4. A mist valve, as set forth in claim 1, wherein said capillary-like channels extend in generally parallel relation along the inside surface of said passageway.

5. A mist valve, as set forth in claim 1, wherein said capillary-like channels terminate 2–3 mm from the outlet end of said passageway.

6. A mist valve, as set forth in claim 1, wherein the surface of said passageway formed by said wall means is open from adjacent the upstream side of the seal closure to said inlet end.

7. A mist valve, as set forth in claim 6, wherein said capillary-like channels are formed in only said first wall with the opposing surface of said second wall being smooth and flat.

8. A mist valve, as set forth in claim 7, wherein said capillary-like channels are half round.

9. A mist valve, as set forth in claim 1, wherein said wall means is generally circular at the inlet end thereof and has a transition section extending between the generally circular inlet end and said generally flat first and second walls changing from the circular shape to the flattened shape.

10. A mist valve, as set forth in claim 9, wherein said wall means is L-shaped with said generally flat first and second walls of the passageway extending approximately perpendicularly of the circular inlet end of said tubular member and said transition section including an approximately 90° bent section.

11. A mist valve, as set forth in claim 10, wherein said outlet end of said passageway is located transversely of the axis of said passageway extending from said outlet end toward said transition section.

12. A mist valve, as set forth in claim 1, wherein a rigid sleeve laterally encloses said wall means from said inlet end to said outlet end of said passageway.

13. A mist valve, as set forth in claim 12, wherein at least a portion of said sleeve extending between the inlet and outlet ends of said wall means is disposed in spaced relation from one of said first and second flat walls in the region of said capillary-like channels and from said part of said wall means which is flexible and vibrates.

14. A device for dispensing a material in a mist-like spray comprising a container for the material to be sprayed having an outlet through which the material is forced out of said container, and a valve positioned at the outlet from said container for receiving the material from the outlet end and for transforming the material into a mist-like spray, said valve comprising an axially elongated tubular member forming a passageway having an inlet end connected to the outlet from said container and arranged to receive the material to be sprayed as a mist and an outlet end from which the mist is sprayed, at least a portion of said tubular member is flattened from the outlet end toward the inlet end, said tubular member having an at-rest condition and a mist spray condition and comprising a generally flat first wall and a generally flat second wall located opposite said first wall with said first and second walls disposed in contact in the at-rest condition of said tubular member from said outlet end and for at least a part of the length of said passageway toward said inlet end, at least one of said first and second walls having capillary-like channels therein extending in the elongated direction of said tubular member and open to said passageway with said channels extending from approximately said outlet end for a part of the length of said passageway disposed in contact in the at-rest condition, at least a part of said tubular member extending between said first and second walls and said inlet end is flexible and vibrates when said passageway is in the mist spraying condition and the material to be sprayed is forced therethrough, and the facing surfaces of said first and second walls defining the opposite sides of said passageway are in sealing contact between the ends of said channels closer to said inlet end and said inlet end of said tubular member and form a seal closure preventing the flow of fluid through said passageway while said tubular member is in the at-rest condition.

15. A mist valve, as set forth in claim 14 wherein said container is a collapsible container.

16. A mist valve, as set forth in claim 14, wherein sad capillary-like channels terminate 2–3 mm from the outlet end of said passageway.

17. A mist valve, as set forth in claims 14 or 15, wherein said first and second walls are joined together along the elongated edges thereof.

18. A mist valve, as set forth in claim 17, wherein said first and second walls are formed integrally.

19. A mist valve, as set forth in claim 18, wherein said capillary-like channels extend in generally parallel relation along the inside surface of said passageway.

20. A mist valve, as set forth in claim 19, wherein the surface of said passageway formed by said tubular member is open from adjacent the upstream side of the seal closure to said inlet end.

21. A mist valve, as set forth in claim 20, wherein said capillary-like channels are formed in only said first wall with the opposing surface of said second wall being smooth and flat.

22. A mist valve, as set forth in claim 18, wherein said capillary-like channels are half round.

23. A mist valve, as set forth in claim 20, wherein said tubular member is generally circular at the inlet end thereof and has a transition section extending between the generally circular inlet end and said generally flat first and second walls changing from the circular shape to the flattened shape.

24. A mist valve, as set forth in claim 20, wherein said tubular member is L-shaped with said generally flat first and second walls extending approximately perpendicularly of the circular inlet end of said tubular member and said transition section including an approximately 90° bent section.

25. A mist valve, as set forth in claim 24, wherein said outlet end of said tubular member is located along and extends transversely of the axis of said tubular member extending from said outlet end toward said transition section.

26. A mist valve, as set forth in claim 25, wherein a rigid sleeve laterally encloses said tubular member from said inlet end to said outlet end thereof.

27. A mist valve, as set forth in claim 24, wherein at least a portion of said rigid sleeve is disposed in spaced relation from one of said first and second flat walls in the region of said capillary-like channels and from said part of tubular member which is flexible and vibrates.

28. A mist valve, as set forth in claim 14 or 15, wherein said tubular member is formed of an elastomeric material.

29. A mist valve, as set forth in claim 14 or 15, wherein said tubular member is formed of a plastics material having the flexible characteristics of an elastomeric material.

* * * * *